United States Patent [19]

Molnick

[11] 4,442,581

[45] Apr. 17, 1984

[54] BUTTON PUNCHER OR CRIMPER

[76] Inventor: Melvin Molnick, 924 W. Ninth St., Upland, Calif. 91786

[21] Appl. No.: 345,815

[22] Filed: Feb. 2, 1982

[51] Int. Cl.[3] ..... B23P 11/00

[52] U.S. Cl. ..... 29/243.5; 72/450; 81/301; 269/158; 269/238

[58] Field of Search ..... 81/301, 302; 29/243.5; 269/158, 238; 72/450

[56] References Cited

U.S. PATENT DOCUMENTS

| | | | |
|---|---|---|---|
| 790,880 | 5/1905 | Boyer | 269/238 |
| 1,419,132 | 6/1922 | Frazer | 269/158 |
| 4,035,901 | 7/1977 | Lux et al. | 29/243.5 |

FOREIGN PATENT DOCUMENTS

| | | | |
|---|---|---|---|
| 929271 | 6/1955 | Fed. Rep. of Germany | 269/158 |
| 162388 | 4/1921 | United Kingdom | 269/158 |

*Primary Examiner*—James L. Jones, Jr.
*Attorney, Agent, or Firm*—Thomas I. Rozsa

[57] ABSTRACT

An improved button puncher or crimper which is capable of vastly improving the efficiency and ease with which adjacent sheets of metal decking are button punched, pinched or pressed together in order to be permanently joined.

8 Claims, 7 Drawing Figures

BUTTON PUNCHER OR CRIMPER

BACKGROUND OF THE INVENTION

The present invention relates to an Improved Button Puncher or Crimper which is capable of vastly improving the efficiency and ease with which adjacent sheets of metal decking are button punched, pinched or pressed together in order to be permanently joined.

In the construction of a floor in a multi-story structure, a metal deck is required as the foundation of each floor. Concrete is subsequently poured over the assembled metal decking. Comparable metal decking is used in the construction of a metal roof. The metal decking is formed from elongated metal sheets which must be joined together at their adjacent longitudinal edges in order to form the completed deck. For example, each sheet of metal decking can be formed from steel sheets conforming to ASTM A611 Grade C or ASTM A446 Grade A steel with a minimum yield of 33,000 psi. The deck finish can be either zinc coated conforming to ASTM A525 Class G-60 or phosphatized topside and baked enamel primer painted underside. Each sheet of metal is in a corrugated design which facilitates structural bonding with the concrete which is poured over the finished metal deck. Each sheet of metal is of uniform width throughout. Typically, the width can range from 24 inches to 32 inches, although widths outside this range are certainly possible. Each sheet of metal is of uniform height or depth, although the height or depth will vary across the width of each sheet due to its corrugated design. Typically, the height or depth of each metal sheet can range from 19/32nds of an inch to 3 inches, although it is possible to have the height of the metal sheet outside this range. Typically, the length or span of each metal sheet can range from 4 feet to 14 feet, although lengths outside this range are certainly possible.

Each metal sheet is designed so that one lengthwise edge is folded over along its length to form a concave edge along the entire length. This edge of each metal sheet is considered to be the female member. The opposite lengthwise edge is bent upward such that it is substantially perpendicular to the base of the metal sheet. This edge of each metal sheet is considered to be the male member. The metal decking is constructed such that each metal sheet is laid side by side in a lengthwise direction such that the male lengthwise edge of each metal sheet is inserted into the female lengthwise edge of the adjacent metal sheet. The male and female edges are then crimped or pressed together in several places along their length in order to join one metal sheet to the next. A multiplicity of such metal sheets are joined in this fashion to form the metal deck. The deck is placed on the supporting framework and welded to the supports.

The tool commonly used to button punch or crimp the male and female lengthwise edges of the metal sheets together has been in use in the prior art for many years. The prior art tool for performing this task essentially looks like a giant pair of pliers. In operation, the jaws of the tool are placed over the assembled male and female lengthwise edge and the handles of the tool are pushed together in order to have the jaws close over the male and female lengthwise edge. In this fashion, the edges are crimped or pressed together. This operation is performed at several locations along the length, to join one metal sheet to the adjacent metal sheet. Due to the thickness of the metal and the small amount of leverage achieved with this prior art tool, use of this plier-like tool to press or crimp the metal together is an extremely slow and exhausting process. A construction worker can become easily fatigued because of the substantial amount of force that must be applied in order to press the male and female edges together throughout the length of the metal sheet, the fact that only his arms are used to apply the force, and the small amount of leverage achieved through use of this tool. It also takes a minute or more for each crimping operation at each location because of the arduous nature of the work and the inefficient way that the metal is pressed together through use of this tool.

SUMMARY OF THE PRESENT INVENTION

It has been discovered, according to the present invention, that if a metal button puncher or crimper is designed so that a worker's foot instead of his arms are used to generate the force which closes the jaws around two pieces of metal to be button punched or crimped together, the entire amount of the worker's weight can be utilized to button punch or crimp the two pieces of metal together and the efficiency and ease of the operation is vastly increased over conventional tools wherein a worker's arms are used to generate the force.

It has also been discovered, according to the present invention, that if a system of appropriate distances is designed into a tool so that the force of the worker's foot is substantially multiplied at the site of the jaws by leverage between the location where force is applied from the worker's foot and the jaws, the amount of effort required to press two pieces of metal together is significantly less than the effort expended by pressing the jaws toward each other through force generated by the worker's arms on handles attached to the jaws.

It has additionally been discovered, according to the present invention, that if a hydraulic system is used to provide the force for closing the jaws on the tool and the force of the hydraulic system is further multiplied by a system of appropriate distances designed into the tool so that the force is substantially multiplied at the site of the jaws by leverage, the speed and efficiency by which the pieces of metal are button punched, pressed, pinched or crimped together is vastly increased.

It has also been discovered, according to the present invention, that a metal button located in one of the two jaws of the tool enables the tool to be used as a button puncher to button punch two pieces of metal together. It has further been discovered that if said button is removable, the tool can be easily converted into a crimper where the two pieces of metal are crimped together instead of button punched together.

It has further been discovered, according to the present invention, that if the area of the jaws in the button punching or crimping tool is large enough to accommodate a multiplicity of jaw lengths, the tool can be used on a variety of metal sheet depths so that a multiplicity of different metal heights can be crimped or button punched together by use of the same tool.

It is therefore an object of the present invention to provide an improved design for a metal button puncher or metal crimper which vastly improves the efficiency with which two pieces of metal such as adjacent sheets of metal decking are button punched, pressed, pinched or crimped together.

It is also an object of the present invention to provide an improved design for a metal button puncher or metal crimper which enables a worker's foot and thereby his entire weight to be used in generating the force which closes the jaws of the tool to button punch or crimp the adjacent pieces of metal together so that the amount of effort required to join the pieces of metal together is significantly less than the effort required when a worker's arms are used to generate the force.

It is a further object of the present invention to provide a design for a button punching or crimping tool wherein a system of appropriate distances is designed into the tool so that the generating force is substantially multiplied at the site of the closing jaws by leverage between the location where the force is applied and the opposing faces of the jaws.

It is another object of the present invention to provide a metal button puncher or crimper which utilizes hydraulic force for permanently joining two pieces of metal.

It is still another object of the present invention to provide a metal button puncher or metal crimper design wherein the button located in one face of the jaws is removable so that the tool can be used as a button puncher when the button is in place and used as a crimper when the button is removed.

It is an additional object of the present invention to provide a tool of very sturdy construction which can be subjected to substantial wear and tear over many years when used on construction projects for button punching or crimping adjacent metal sheets together to form the decking for a floor of a multi-story structure or the roof of a structure.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation there is illustrated:

DETAILED DESCRIPTION OF THE PREFERRED EMBODIMENT

Figure 1:
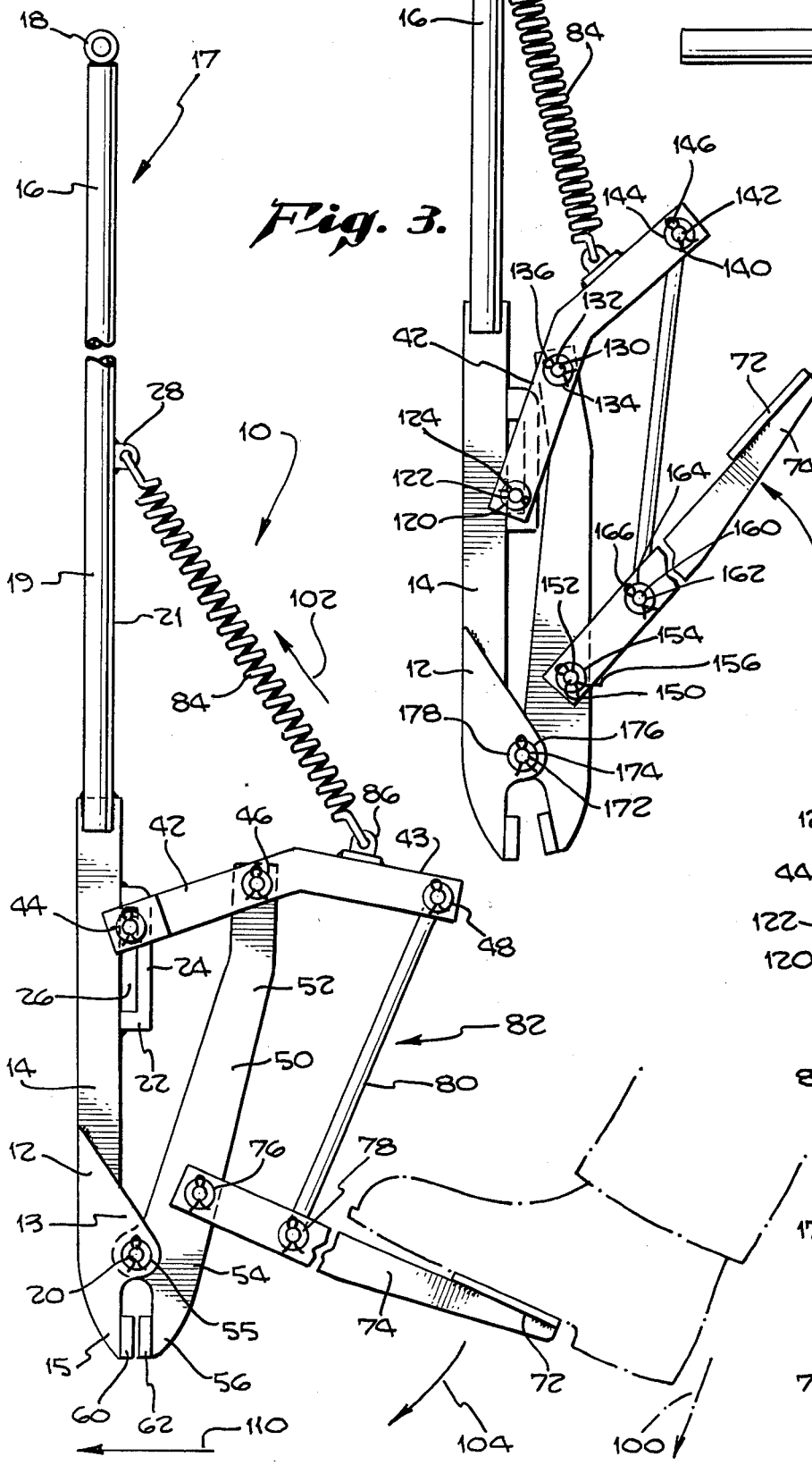
FIG. 1 is an elevational side view of a manually operated improved button puncher or crimper in a closed position.

With reference to the drawings of the invention in detail and more particularly to FIG. 1, there is shown at 10 an elevational side view of the preferred embodiment of a manually operated version of the present invention. The apparatus contains a lower base fixed jaw receiving member 12 which is rigidly attached at its upper portion to the lower end of lower fixed body 14. Lower fixed body 14 is an elongated shaft which is generally cylindrical in shape. Lower fixed body 14 is rigidly attached at its upper end to the lower end of upper fixed body 16. Upper fixed body 16 is also an elongated shaft which is generally cylindrical in shape. The upper end of upper fixed body 16 terminates in handle 18. Handle 18 can be an elongated shaft which is rigidly attached at approximately its longitudinal midpoint to the upper portion of upper fixed body 16. If the lower base fixed jaw receiving member 12, the lower fixed body 14, the upper fixed body 16 and the handle 18 are made of metal, the various components can be rigidly attached as described above by being welded together. When assembled together from bottom to top, the lower base fixed jaw receiving member 12, the lower fixed body 14, and the upper fixed body 16 comprise a rigid longitudinal fixed structure which is the primary fixed body 17. The primary fixed body 17 has a forward face 19 and a rearward face 21.

The lower base fixed jaw receiving member 12 contains a rearwardly protruding portion 13 containing movable jaw receiving member means 20. The rearward lower portion 15 of the lower base fixed jaw receiving member 12 is partially concave at its upper area and essentially flat for most of the length of its lower area, thereby being able to receive the fixed jaw 60. The fixed jaw 60 is rigidly attached to the rearward lower essentially flat portion of the lower base fixed jaw receiving member 12.

A cantilever arm receiving member 22 is located on the rearward face of the lower fixed body 14 and is rigidly attached to it. The cantilever arm receiving member 22 comprises a fixed bracket 24 which extends rearwardly from the rear face 21 and a sliding chamber 26 which has the rearward face 21 of the lower fixed body 14 for one lengthwise wall and the interior edges of the fixed bracket 24 as its other walls. The fixed bracket 24 begins approximately 40 percent up the height of the lower fixed body 14 and extends upwardly for approximately another 40 percent of the height of the lower fixed body 14.

The upper fixed body 16 contains a first spring retainer eye loop 28 rigidly attached to its rearward face 21. The first spring retainer eye loop 28 is located approximately 20 percent up the height of the upper fixed body 16.

The movable portions or control linkage of the present invention are as follows. The moving parts of the improved button puncher or crimper 10 are supported by a movable cantilever arm 42. The movable cantilever arm 42 is elongated in overall design. The movable cantilever arm 42 as shown in FIG. 1 is bent at approximately a 150 degree angle at approximately the midpoint along its length. The angle is not critical and can vary from the degree given. It is also within the spirit and scope of the present invention for the movable cantilever arm 42 to be straight and not bent at any portion. The movable cantilever arm 42 contains three hinge or pivot means: a first hinge or pivot means 44 located adjacent the end closest to the cantilever arm receiving member 22; a second hinge or pivot means 46 located in the area near the longitudinal midpoint of the movable cantilever arm 42; and a third hinge or pivot means 48 located adjacent the end of the movable cantilever arm 42 furthest from the cantilever arm receiving member 22.

The first hinge or pivot means 44 slidably connects the movable cantilever arm 42 to the sliding chamber 26 within the fixed bracket 24 of the cantilever arm receiving member 22. The fixed bracket 24 serves to provide the cantilever support for the movable cantilever arm 42 while the first hinge or pivot means 44 permits the movable cantilever arm 42 to slide up and down within sliding chamber 26.

A movable jaw receiving member 50 is movably and rotatably attached at its upper end to the movable cantilever arm 42 by second hinge or pivot means 46. The movable jaw receiving member 50 is elongated and contains an upper shaft portion 52 and a forwardly protruding lower base portion 54 which includes means 55 for receiving the movable jaw receiving means 20. The rearward lower portion 56 of the lower base portion 54 is partially concave at its upper area and essentially flat for most of the length of its lower area, thereby being able to receive a movable jaw 62. The movable jaw 62 is rigidly attached to the rearward lower essentially flat portion 56 of the lower base portion 54 of movable jaw receiving member 50. The movable jaw receiving member 50 is movably and rotatably attached to the lower base fixed jaw receiving member 12 at the location of their respective protruding portions, the forwardly protruding lower base portion 54 and the rearwardly protruding lower base portion 13, by the movable jaw receiving means 20. When placed together in this fashion, their respective upper concave portions form a hemisphere and their substantially flat portions form opposing substantially parallel walls when the improved button puncher or crimper 10 is in its closed position. In this manner, the opposing faces of the fixed jaw 60 and movable jaw 62 come in contact with each other when the improved button puncher or crimper 10 is in its closed position.

The movable portions of the improved button puncher or crimper 10 are activated in the manual version of the invention by force applied to a foot pedal 72. As shown in FIG. 1, the foot pedal 72 is integrally formed with the cantilever foot pedal arm 74. The cantilever foot pedal arm 74 is movably and rotatably attached at one end to the lower area of the upper shaft portion 52 of the movable jaw receiving member 50 by fourth hinge or pivot means 76. The cantilever foot pedal arm 74 is directly attached to the movable cantilever arm 42 by connecting arm 80. Connecting arm 80 is an elongated bar. At its upper end, connecting arm 80 is movably and rotatably connected adjacent to one end of the movable cantilever arm 42 by third hinge or pivot means 48. At its lower end, the connecting arm 80 is movably and rotatably connected to the cantilever foot pedal arm 74 by fifth hinge or pivot means 78. The connection is located between the fourth hinge or pivot means 76 and the foot pedal 72. The cantilever foot pedal arm 74, the foot pedal 72, and the connecting arm 80 comprise the activating means 82 for the manual version of the present invention.

The movable portions of the improved button puncher or crimper 10 are retained in their neutral or open position by return spring 84. The upper portion of return spring 84 is attached to first spring retainer eye loop 28 on the rearward face 21 of upper fixed body 16. The lower portion of return spring 84 is attached to second spring retainer eye loop 86. The second spring retainer eye loop 86 is rigidly attached to the upper pprtion 43 of movable cantilever arm 42 at a location between second hinge or pivot means 46 and third hinge or pivot means 48.

Figure 7:
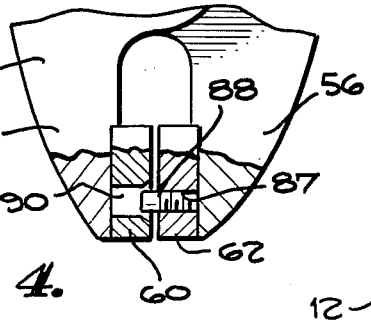
FIG. 7 is an exploded view of the jaw area of the present invention.

As shown in the exploded view in FIG. 7, movable jaw 62 contains button receiving means 87 to receive a removable button 88. Fixed jaw 60 contains button accommodating means 90 to receive the forward end of the removable button 88 when the improved button puncher 10 is in its closed position. In order to convert the present invention from the button puncher to a crimper, all that need be done is to remove the removable button 88. For example, if the button receiving means 87 is a screw thread and the removable button 88 has a threaded shaft on its end, the removable button 88 can easily be screwed in place when the present invention is used as a button puncher and the removable button 88 can easily be unscrewed and removed when the present invention is used as a crimper.

As previously discussed, a purpose of the present invention is to button punch, crimp, or press together adjacent pieces of metal. The tool used in the prior art essentially looks like a giant pair of pliers wherein the jaws of the tool are placed over the adjacent pieces of metal and the handles of the tool are pushed together in order to have the jaws close over the two pieces of metal. This operation is very tiring as only the worker's arms are used. The present invention permits a worker's foot instead of his arms to be used. In this way, the leg muscles instead of the arm muscles are used and the entire weight of the worker can be used to generate the force which closes the jaws around the two pieces of metal to be button punched, crimped or pressed together.

Figure 3:
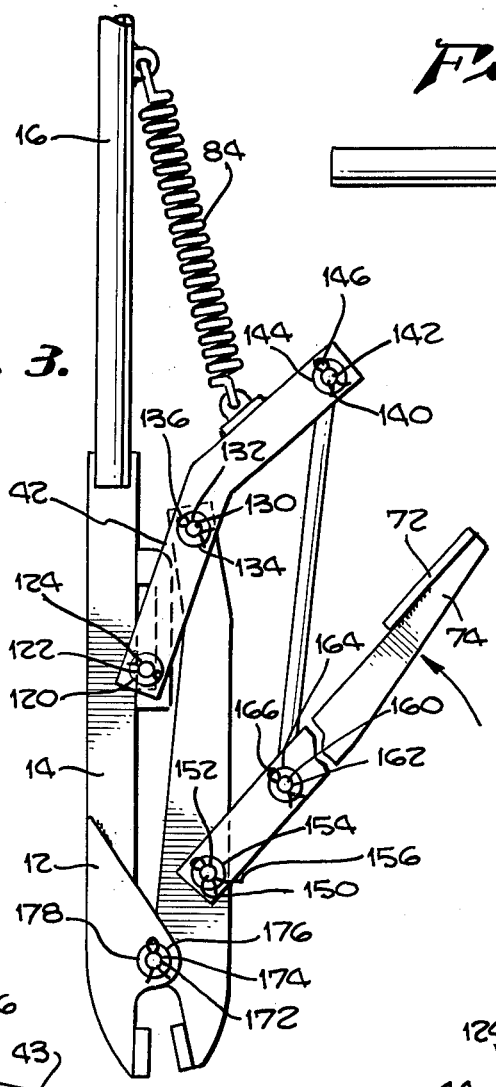
FIG. 3 is a partial elevational side view of a manually operated improved button puncher or crimper in an open position, showing the button in place in one of the jaws.
Figure 5:
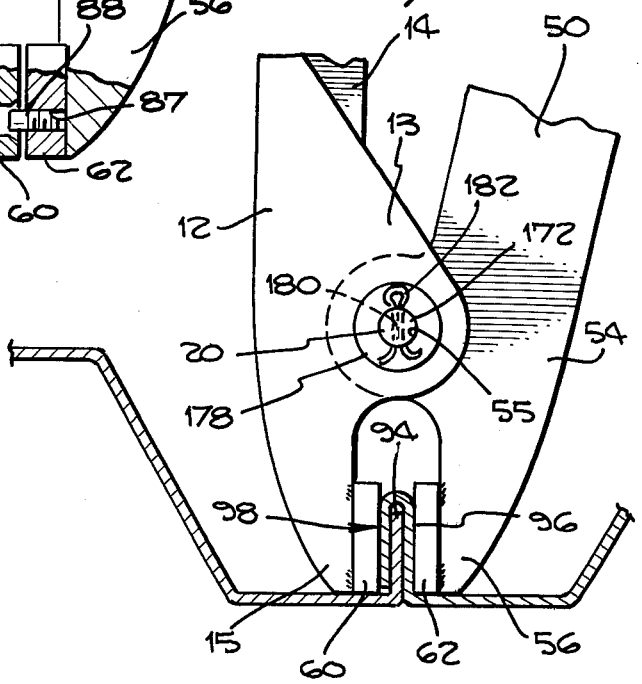
FIG. 5 is an enlarged detailed view of the button punching or crimping jaws in operation.

In operation, the manual version of the improved button puncher or crimper 10 is operated as follows. Two adjacent pieces of metal to be button punched or crimped are placed together as shown in FIG. 5. If, for example, the two pieces of metal are sheets of metal decking as previously described, the male lengthwise edge 94 is inserted into the female lengthwise edge 96 as shown in the cross-sectional view of FIG. 5, to form adjacent metal structure 98. The worker then places the improved button puncher or crimper 10 over the area of the adjacent metal structure 98 to be button punched or crimped together such that fixed jaw 60 and movable jaw 62 are on opposite sides of the adjacent metal structure 98 as shown in FIG. 5. In FIG. 5, the present invention is being used as a crimper with the button removed. Initially, the improved button puncher or crimper 10 is in its neutral position as shown in FIG. 3. The return spring 84 is in its unflexed position, and movable cantilever arm 42 is drawn upward to its highest position while first hinge or pivot means 44 is at its lowermost position inside sliding chamber 26. Connecting arm 80 serves to draw the foot pedal 72 and the cantilever foot pedal arm 74 to their respective uppermost positions. Therefore, movable cantilever arm 42 and cantilever foot pedal arm 74 serve to pull movable jaw receiving member 50 to its furthest rearward position and movable jaw 62 is at its furthest rearward position so that jaws 60 and 62 are as far apart as they can be.

The worker actuates the improved button puncher or crimper 10 by placing his foot on foot pedal 72 and bearing down on it with pressure from his leg muscles and possibly his entire weight. The downward force 100 from the worker's foot counteracts the upward force 102 generated by return spring 28 and foot pedal 72 is caused to swing in a downward arc 104 as shown in FIG. 1. The downward force 100 on foot pedal 72 is transmitted along cantilever foot pedal arm 74. The downward force 100 is transmitted through connecting arm 80 to movable cantilever arm 42. Movable cantilever arm 42 is forced to move in a downward direction while first hinge or pivot means 44 slides upward inside sliding chamber 26. Movable cantilever arm 42 is brought to a stop when first hinge or pivot means 44 reaches the uppermost portion of sliding chamber 26.

The downward force 100 generated by the worker's foot causes cantilever foot pedal arm 74 to move downwardly and also causes the protruding portion of movable cantilever arm 42 to move downwardly, as just discussed. These two downward movements exert a downward and forward force on movable jaw receiving member 50. These forces cause movable jaw receiving member 50 to rotate about movable jaw receiving means 20 and cause movable jaw 62 to move forward toward fixed jaw 60, thereby button punching or crimping the adjacent metal structure 98 as shown in FIG. 5.

The improved button puncher or crimper is designed not only to utilize the force of the worker's leg and entire weight in order to generate the downward force 100, but to additionally multiply this downward force 100 by a double leverage. The height of the upper shaft portion 52 of movable jaw receiving member 50 over the height of the forwardly protruding lower base portion 54 of the movable jaw receiving member 50 generates one leverage moment which is comparable to the leverage generated from the giant pair of pliers. The force applied to the movable jaw receiving member 50 at its uppermost location in the area of second hinge or pivot means 46 is further multiplied by the distance from second hinge or pivot means 46 to third hinge or pivot means 48. This double leverage serves to substantially enhance the downward force 100 generated by the worker's foot. Therefore, the worker generates a downward force 100 on foot pedal 72. This is transmitted through cantilever foot pedal arm 74 to connecting arm 80. Connecting arm 80 transmits the force to movable cantilever arm 42 adjacent its farthest extremity at the location of third hinge or pivot means 48. Leverage action from the distance between second hinge or pivot means 46 and third hinge or pivot means 48 then enhances and multiplies this force. The force is transmitted along movable cantilever arm 42 to movable jaw receiving member 50 at the location of second hinge or pivot means 46. This force is further multiplied or enhanced by the leverage of the height of upper shaft portion 52 over the height of forwardly protruding lower base portion 54. The force causes movable jaw receiving member 50 to rotate about movable jaw receiving means 20, thereby forcing movable jaw 62 toward fixed jaw 60 and generating a substantially enhanced closing force 110 which serves to button punch or crimp the female lengthwise edge 96 to the male lengthwise edge 94. Therefore, the adjacent metal structure 98 is button punched or crimped together with much greater efficiency and ease than was achieved through apparatus in the prior art because the worker's leg, leg muscles and entire weight are used to generate the downward jaw closing force 100 and this force from the worker is substantially enhanced because of a double leverage achieved through the unique design of the present invention.

After the adjacent metal structure 98 has been satisfactorily button punched or crimped together, the worker releases his foot from foot pedal 72. The upward force 102 from return spring 84 is now the dominant force. Return spring 84 exerts an upward force on second spring retainer eye loop 86, which transmits the force to movable cantilever arm 42. Movable cantilever arm 42 moves upward while first hinge or pivot means 44 returns to its lowermost position inside sliding chamber 26. The upward force 102 is transmitted through movable cantilever arm 42 to connecting arm 80 which in turn transmits the upward force to cantilever foot pedal arm 74. This causes foot pedal 72 to swing upwardly. The upward force 102 is also transmitted along cantilever foot pedal arm 74 to movable jaw receiving member 50 which causes movable jaw receiving member 50 to rotate about movable jaw receiving means 20 such that the movable jaw receiving member 50 swings outwardly and movable jaw 62 returns to its opened and furthest position from fixed jaw 60. The worker then raises the improved button puncher or crimper 10 and places it over the next adjacent metal structure 98 to be button punched or crimped.

In describing the various forces above, it should be noted that each force can be broken into a vertical component and a horizontal component, only one of which creates the force to generate the movements described above. The forces generated conform the standard structural forces as discussed in familiar structures texts such as "Statics Of Deformable Solids" by Bisplinghoff, Mar, and Pian published in 1965 by Addison-Wesley Publishing Company, Inc. Leverage forces discussed above conform to standard leverage forces as discussed in familiar physics texts such as "Introductory Applied Physics" by Harris and Hemmerling published in 1955 by McGraw Hill Book Company, Inc.

Figure 6:
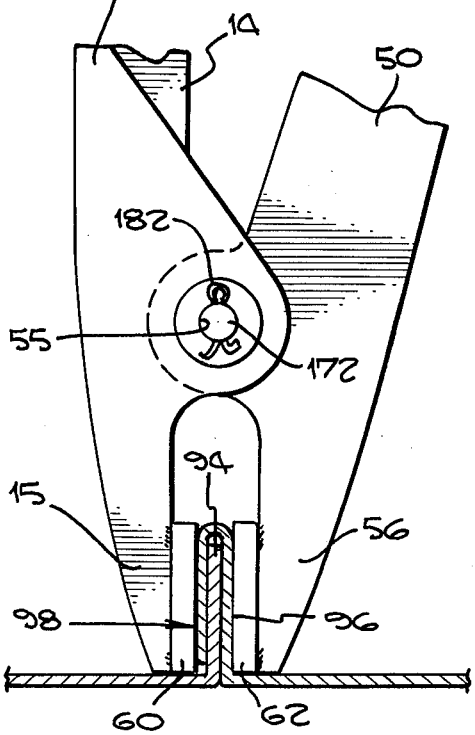
FIG. 6 is an enlarged detailed view of an alternate form of the button punching or crimping jaws in operation.

In an alternative embodiment of the present invention, the essentially flat portions of rearward lower portion 15 of lower base fixed jaw receiving member 12 and lower base portion 56 of movable jaw receiving member 50 can be lengthened to accommodate a larger fixed jaw 60 and larger movable jaw 62 respectively. This is illustrated in FIG. 6 where the jaws 60 and 62 of the improved button puncher or crimper have been increased in height to accommodate a higher male lengthwise edge 94 and higher female lengthwise edge 96 to therefore button punch or crimp a higher or taller adjacent metal structure 98.

As discussed above, the movable portions of the improved button puncher or crimper 10 rotate about first hinge or pivot means 44, second hinge or pivot means 46, third hinge or pivot means 48, fourth hinge or pivot means 76, fifth hinge or pivot means 78 and movable jaw receiving means 20. In each of these cases, the hinge or pivot means 44, 46, 48, 76, and 78 or movable jaw receiving means 20 can consist of a shaft which has a head at one end, a washer surrounding the shaft and adjacent the headed end, a second washer adjacent the opposite end of the shaft, a hole running transversely through the shaft adjacent this opposite end, and a cotter pin placed through the transverse hole. This is illustrated in the rear view of the improved button puncher or crimper 10 shown in FIG. 2. First hinge or pivot means 44 contains a shaft 114 which extends through sliding chamber 26. On one end of the shaft 114 and integral therewith is a head 116. A washer 118 is located adjacent the head 116 and to one side of fixed bracket 24. A second washer 120 is located on the shaft 114 on the opposite side of bracket 24. A transverse hole 122 runs through the shaft 114 just to the outside of second washer 120 and a cotter pin 124 runs through the transverse hole 122 in order to keep the entire first hinge or pivot means 44 together. Each of the other hinge or pivot means, 46, 48, 76 and 78 contains a comparable structure. Movable cantilever arm 42 contains a transverse hole 130 to accommodate shaft 132 of second hinge or pivot means 46; and also contains a transverse hole 140 to accommodate shaft 142 of third hinge or pivot means 48. In FIG. 1 and FIG. 3, second washer 134 and cotter pin 136 of second hinge or pivot means 46 are shown, and second washer 144 and cotter pin 146 of third hinge or pivot means 48 are shown. Upper shaft portion 52 of movable jaw receiving member 50 contains a transverse hole 150 to accommodate shaft 152 of fourth hinge or pivot means 76. Second washer 154 and cotter pin 156 is also shown. Cantilever foot pedal arm 74 contains a transverse hole 160 to accommodate shaft 162 of fifth hinge or pivot means 78. Second washer 164 and cotter pin 166 is also shown in FIG. 1 and FIG. 3.

Figure 2:
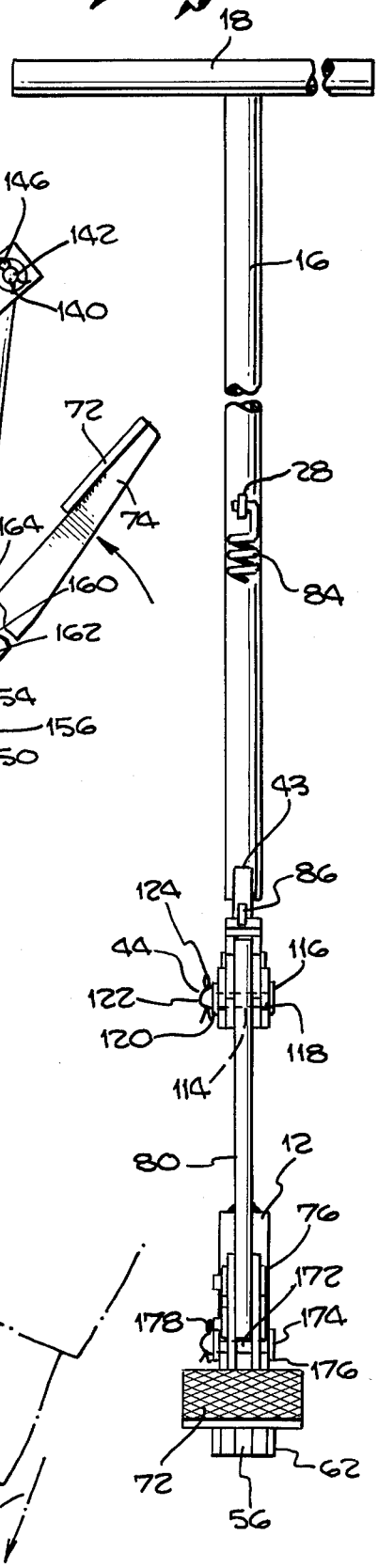
FIG. 2 is an elevational rear view of a manually operated improved button puncher or crimper.

To accommodate movable jaw receiving means 20, the rearwardly protruding portion 13 of lower base fixed jaw receiving member 12 contains a transverse hole 11, and the forwardly protruding lower base portion 54 of elongated movable jaw receiving member 50 contains a transverse hole 55. The rearwardly protruding portion 13 and the forwardly protruding portion 54 fit together so that their respective transverse holes 11 and 55 are aligned. As shown in FIG. 2, movable jaw receiving means 20 contains a shaft 172 which extends through both transverse holes 11 and 55. On one end of shaft 172 and integral therewith is head 174. A washer 176 is located adjacent the head 174 and to one side of rearwardly protruding portion 13. A second washer 178 is located on the shaft 172 on the opposite side of rearwardly protruding portion 13. A transverse hole 180 runs through the shaft 172 just to the outside of second washer 178 and a cotter pin 182 runs through transverse hole 180 in order to keep the entire movable jaw receiving means 20 intact.

In the preferred embodiment, all of the above components of the improved button puncher or crimper 10 are made of metal. One type of metal which can be used is Chrome Molley Steel. All of the components of each hinge or pivot means and the movable jaw receiving means can also be made of hardened steel. The nonmoving parts therefore can be welded together at their fixed points. For example, first spring retainer eye loop 28 can be welded to upper fixed body 16, second spring retainer eye loop 86 can be welded to movable cantilever arm 42, lower fixed body 14 can be welded to lower base fixed jaw receiving member 12, lower fixed body 14 can be welded to upper fixed body 16, and upper fixed body can be welded to handle 18. Foot pedal 72 can be integral with cantilever foot pedal arm 74 or welded to it.

By way of example, the height of the improved button puncher or crimper 10 from the lowermost portion of lower base fixed jaw receiving member 12 to the top of the handle 18 can be approximately 94 inches. Of this amount, the maximum height of lower base fixed jaw receiving member can be 8 inches and the length of fixed upper body 16 can be 76 inches. The width of handle 18 can be approximately 12 inches. The length of the cantilever foot pedal arm can be 18 inches and the length of connecting arm 80 can be 13 inches. The height of movable jaw receiving member 50 can be 16 inches and the length of movable cantilever arm 42 can be 12½ inches. All of these dimensions are intended to be approximate and slight variations are within the scope of this disclosure. It is also within the spirit and scope of the present invention to vary these dimensions without departing from the novelty of the imrpoved button puncher or crimper.

Figure 4:
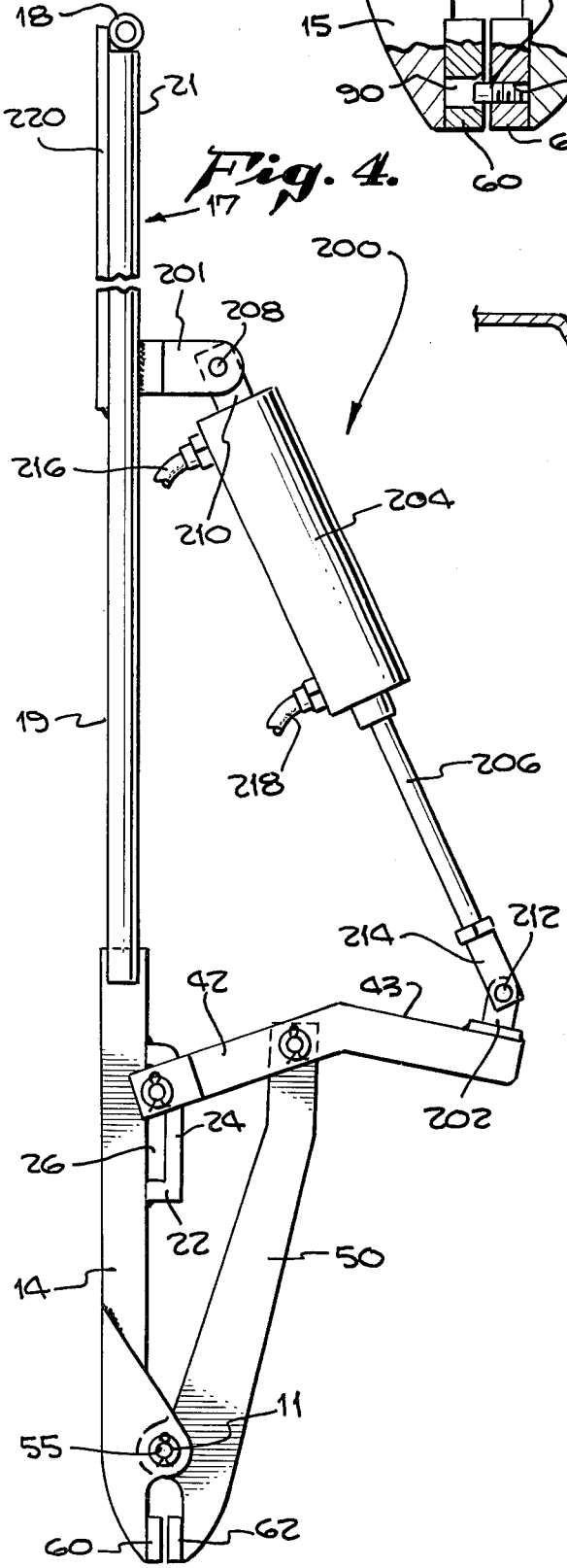
FIG. 4 is an elevational side view of a hydraulically operated improved button puncher or crimper in a closed position.

An alternative embodiment of the present invention is shown in FIG. 4. Instead of a manually operated version, FIG. 4 discloses a hydraulically operated embodiment 200 of the improved button puncher or crimper. In the hydraulically operated version 200, the following components have been eliminated from the manually operated version: foot pedal 72, cantilever foot pedal arm 74, connecting arm 80, third, fourth and fifth hinge or pivot means 48, 76 and 78 respectively, return spring 84, first spring retainer eye loop 28 and second spring retainer eye loop 86. The following new components are present in the hydraulically actuated version 200 of the improved button puncher or crimper. A first support bracket 201 is located on the rear face 21 of upper fixed body 16. It can be at approximately the same location as first spring retainer eye loop 28. A second support bracket 202 is located on the upper surface 43 of movable cantilever arm 42, adjacent its protruding end. If each support bracket, 201 and 202 is made of metal, they can be rigidly attached by being welded in place. First support bracket 201 and second support bracket 202 support hydraulic cylinder 204 and hydraulic cylinder rod 206. First hydraulic hinge or pivot means 208 is located on first support bracket 201 and movably and rotatably supports the upper portion of hydraulic cylinder 204. First hydraulic cylinder connecting means 210 connects hydraulic cylinder 204 to first hydraulic hinge or pivot means 208. Second hinge or pivot means 212 is located on second support bracket 202 and supports the lower portion of hydraulic cylinder rod 206. First hydraulic cylinder rod connecting means 214 connects hydraulic cylinder rod 206 to second hydraulic hinge or pivot means 212. Also shown protruding from hydraulic cylinder 204 are first air hose 216 and second air hose 218. Additional support bracket 220 is shown on the front face 19 of fixed upper body 16 and also partially attached to handle 18.

In operation, the hydraulic version of the improved button puncher or crimper 200 is operated as follows. The apparatus is placed over the adjacent metal structure 98 as illustrated in FIG. 5 and FIG. 6. Initially, the improved button puncher or crimper 200 is in a neutral position, comparable to that shown for the manual version 10 in FIG. 3. The hydraulic cylinder rod 206 is drawn up into the hydraulic cylinder 204. This upward force 102 causes movable cantilever arm 42 to be drawn upward to its highest position while first hinge or pivot means 44 is at its lowermost position inside sliding chamber 26. This serves to pull movable jaw receiving member 50 to its furthest rearward position and movable jaw 62 is at its farthest rearward position so that jaws 60 and 62 are as far apart as they can be.

The worker actuates the hydraulic mechanism, causing hydraulic cylinder rod 206 to move outward and downward, out of hydraulic cylinder 204. The downward force 100 from the outwardly and downwardly moving hydraulic cylinder rod 206 is transmitted to movable cantilever 42 at the location of second hydraulic hinge or pivot means 212. Movable cantilever arm 42 is brought to a stop when first hinge or pivot means 44 reaches the uppermost portion of sliding chamber 26. The downward motion of movable cantilever arm 42 causes movable jaw receiving member 50 to rotate movable jaw receiving means 20 and causes movable jaw 62 to move forward toward fixed jaw 60, thereby button punching or crimping the adjacent metal structure 98 as shown in FIG. 5.

As with the manual version, the hydraulic version of the improved button puncher or crimper 200 is designed to additionally multiply this downward hydraulic force 100 by a double leverage. The height of upper shaft portion 52 of movable jaw receiving member 50 over the height of the forwardly protruding lower base portion 54 of the movable jaw receiving member 50 generates one leverage moment which is comparable to the leverage generated from the giant pair of pliers. The force applied to the movable jaw receiving member 50 at its uppermost location in the area of second hinge or pivot means 46 is further multiplied by the distance from second hinge or pivot means 46 to second hydraulic hinge or pivot means 212. This double leverage serves to substantially enhance the downward force 100 generated by the hydraulic mechanism. It has been experimentally determined that a force of 100 pounds per square inch of air pressure generated by the hydraulic mechanism becomes approximately 500 pounds per square inch at the site of jaws 60 and 62. The force 100 generated from the hydraulic cylinder rod 206 is transmitted to second hydraulic hinge or pivot means 212. This is transmitted to the farthest extremity of movable cantilever arm 42 which is adjacent to the second hydraulic hinge or pivot means 212. Leverage action from the distance between second hinge or pivot means 46 and second hydraulic hinge or pivot means 212 then enhances or multiplies this force. The force is transmitted along movable cantilever arm 42 to movable jaw receiving member 50 at the location of second hinge or pivot means 46. This force is further multiplied or enhanced by the leverage of the height of upper shaft portion 52 over the height of forwardly protruding lower base portion 54. The force causes movable jaw receiving member 50 to rotate about movable jaw receiving means 20, thereby forcing movable jaw 62 toward fixed jaw 60 and generating a substantially enhanced closing force 110 which serves to button punch or crimp the female lengthwise edge 96 to the male lengthwise edge 94. Therefore, the adjacent metal structure 98 is button punched or crimped together with much greater efficiency and ease than was achieved through apparatus in the prior art. This is shown in FIG. 4.

After the adjacent metal structure 98 has been satisfactorily button punched or crimped together, the worker causes the hydraulic mechanism to reverse itself and the hydraulic cylinder rod 206 returns to its original position inside hydraulic cylinder 204. The upward force is transmitted through movable cantilever arm 42 and thence to movable jaw receiving member 50. This causes movable jaw receiving member 50 to rotate about movable jaw receiving means 20 such that the movable jaw receiving member 50 swings outwardly and movable jaw 62 returns to its opened and furthest position from fixed jaw 60. The worker then raises the improved button puncher or crimper 200 and places it over the next adjacent metal structure 98 to be button punched or crimped.

Both the manual and the hydraulic versions of the improved button puncher or crimper have been described in great detail. It is also within the spirit and scope of the present invention to describe this improved button puncher or crimper in more general terms. The entire fixed portions which includes the lower base fixed jaw receiving member 12 and its components, the lower fixed body 14, the upper fixed body 16, and the handle 18 can be described as an elongated vertically oriented stationary member comprising a handle at its upper end and means adapted to rigidly receive a fixed jaw at its lower end. The moving control linkage which includes movable cantilever arm 42, first, second, and third hinge or pivot means 44, 46, and 48 respectively, and movable jaw receiving member 50 and its components can be described as a movable control linkage pivotally attached to said elongated vertically oriented stationary member wherein said movable control linkage comprises a movable connecting member and a movable lower shaft member connected at its upper end to the movable connecting member and further adapted to rigidly receive a movable jaw at its lower end. The mechanical coupling linkage which consists of fourth and fifth hinge or pivot means 76 and 78 respectively and connecting arm 80 can be described as a mechanical coupling linkage which pivotally couples the middle area of the foot pedal to one end of the connecting member of said movable control linkage and also pivotally couples the forward end of said foot pedal to said lower shaft member of said movable control linkage.

In an even broader description, lower base fixed jaw receiving member 12 and its components, the lower fixed body 14, the upper fixed body 16, and movable jaw receiving member 50 can be described as a vertically oriented pliers type mechanism adapted to receive two or more pieces of metal to be button punched or crimped together. The other moving portions which include movable cantilever arm 42, first, second and third hinge or pivot means 44, 46, and 48 respectively, fourth and fifth hinge or pivot means 76 and 78 respectively and connecting arm 80 can be described as a mechanical control linkage which pivotally couples the forward end of the foot pedal 72 to one side of said vertically oriented pliers type mechanism and at the same time provides a mechanical advantage for applying a closing force to the pliers type mechanism every time a downward force is exerted on the foot pedal 72. In the hydraulic version of the improved button puncher or crimper, these latter elements can be described as a mechanical control linkage which pivotally couples the open or protruding end of the hydraulic cylinder rod 206 to one side of the vertically oriented pliers type mechanism and at the same time provides a mechanical advantage for applying a closing force to the pliers type mechanism every time a downward force is exerted on the mechanical control linkage by the hydraulic cylinder rod 206 moving out of the hydraulic cylinder 204 and for applying an opening force when the hydraulic cylinder rod 206 returns inside the hydraulic cylinder 204.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment, and not to show all of the various forms of modification in which the invention might be embodied.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. An improved button puncher or crimper comprising:

a. a lower base fixed jaw receiving member comprising a rearwardly protruding portion and a lower substantially flat rearward portion beneath the rearwardly protruding portion;

b. an elongated lower fixed body rigidly attached at its lower end to the upper portion of said lower base fixed jaw receiving member;

c. an elongated upper body rigidly attached at its lower end to the upper end of said elongated lower body;

d. a handle rigidly attached to the upper end of said elongated upper fixed body;

e. said lower base fixed jaw, said elongated lower body, and said elongated upper body having a uniform forward face;

f. said elongated lower body and said elongated upper body having a uniform rear face;

g. a fixed jaw rigidly attached to the lower substantially flat rearward portion of said lower base fixed jaw receiving member;

h. a cantilever arm receiving member rigidly attached to the rear face of said elongated lower body member;

i. said cantilever arm receiving member comprising a bracket with an elongated chamber between the bracket and the rear face of said elongated lower body member;

j. a movable cantilever arm;

k. said movable cantilever arm containing a first pivot means adjacent one end, a second pivot means adjacent its central longitudinal area, and a third pivot means adjacent its opposite end;

l. said movable cantilever means being slidably and rotatably supported within said elongated chamber of said cantilever arm receiving member by said first pivot means;

m. a spring interconnecting said movable cantilever arm to the rear face of said elongated upper body member;

n. a movable jaw receiving member comprising an upper shaft portion and a lower base portion which further comprises a forwardly protruding upper portion and a lower substantially flat forward portion beneath the forwardly protruding portion;

o. a movable jaw rigidly attached to the lower substantially flat forward portion of said lower base portion of the movable jaw receiving member;

p. the upper end of the upper shaft portion of said movable jaw receiving member being movably and rotatably attached to said movable cantilever arm by said second pivot means;

q. the rearwardly protruding protion of said lower base fixed jaw receiving member being movably and rotatably connected to the forwardly protruding portion of the lower base portion of said movable jaw receiving member by a movable jaw receiving means such that said fixed jaw and said movable jaw face each other;

r. said movable jaw receiving member containing a fourth pivot means located in the lower area of its upper shaft portion;

s. an elongated cantilever foot pedal arm containing a foot pedal at one end;

t. said elongated cantilever foot pedal arm being movably and rotatably connected at its end opposite the foot pedal to said movable jaw receiving member by said fourth pivot means;

u. said elongated cantilever foot pedal arm containing a fifth pivot means between said fourth pivot means and said foot pedal; and v. an elongated connecting arm being movably and rotatably attached at one end to said movable cantilever arm by said third pivot means and being movably and rotatably attached at its other end to said elongated cantilever foot pedal arm by said fifth pivot means;

w. whereby a downward force applied to said foot pedal is transmitted through said elongated cantilever foot pedal arm to said elongated connecting arm, to said movable cantilever arm and then to said movable jaw receiving member thereby causing said movable jaw receiving member to rotate about said movable jaw receiving means so that the movable jaw is forced to close against the fixed jaw with the result that any adjacent pieces of metal which may have been placed between the jaws when open will then be button punched, pressed or crimped together, and further wherein the force applied to said foot pedal is substantially enhanced at the site of the fixed and movable jaws by a double leverage action arising from the distance between said second pivot means and said third pivot means and further by the height of the upper shaft portion of the movable jaw receiving member over the height of the lower base portion of the movable jaw receiving member and wherein said spring causes that fixed and movable jaws to return to their opened position and said foot pedal to return to its elevated position once the downward force on the foot pedal is released.

2. The invention as defined in claim 1 wherein said movable jaw contains a removable button receiving means which accommodates a removable button placed therein and said fixed jaw contains accommodating means to receive the protruding end of the removable button when the button puncher or crimper is in its closed position.

3. The invention as defined in claim 1 wherein said fixed jaw contains a removable button receiving means which accommodates a removable button placed therein and said movable jaw contains accommodating means to receive the protruding end of the removable button when the button puncher or crimper is in its closed position.

4. The invention as defined in claim 1 wherein the components of the improved button puncher or crimper are made of hardened metal such as Chrome-Molley Steel.

5. An improved button puncher or crimper comprising:

a. a lower base fixed jaw receiving member comprising a rearwardly protruding portion and a lower substantially flat rearward portion beneath the rearwardly protruding portion;

b. an elongated lower fixed body rigidly attached at its lower end to the upper portion of said lower base fixed jaw receiving member;

c. an elongated upper body rigidly attached at its lower end to the upper end of said elongated lower body;

d. a handle rigidly attached to the upper end of said elongated upper fixed body;

e. said lower base fixed jaw, said elongated lower body, and said elongated upper body having a uniform forward face;

f. said elongated lower body and said elongated upper body having a uniform rear face;

g. a fixed jaw rigidly attached to the lower substantially flat rearward portion of said lower base fixed jaw receiving member;

h. a cantilever arm receiving member rigidly attached to the rear face of said elongated lower body member;

i. said cantilever arm receiving member comprising a bracket with an elongated chamber between the bracket and the rear face of said elongated lower body member;

j. a movable cantilever arm;

k. said movable cantilever arm containing a first pivot means adjacent one end and a second pivot means adjacent its central longitudinal area;

l. said movable cantilever means being slidably and rotatably supported within said elongated chamber of said cantilever arm receiving member by said first pivot means;

m. a movable jaw receiving member comprising an upper shaft portion and a lower base portion which further comprises a forwardly protruding upper portion and a lower substantially flat forward portion beneath the forwardly protruding portion;

n. a movable jaw rigidly attached to the lower substantially flat forward portion of said lower base portion of the movable jaw receiving member;

o. the upper end of the upper shaft portion of said movable jaw receiving member being movably and rotatably attached to said movable cantilever arm by said second pivot means;

p. the rearwardly protruding portion of said lower base fixed jaw receiving member being movably and rotatably connected to the forwardly protruding portion of the lower base portion of said movable jaw receiving member by a movable jaw receiving means such that said fixed jaw and said movable jaw face each other;

q. a first support bracket rigidly attached to the rear face of said elongated upper body;

r. said first support bracket containing a first hydraulic pivot means;

s. a second support bracket rigidly attached to said movable cantilever arm adjacent its protruding end;

t. said second support bracket containing a second hydraulic pivot means;

u. a hydraulic actuating means comprising a hydraulic cylinder and a hydraulic cylinder rod which moves within it;

v. said hydraulic cylinder being movably and rotatably supported by said first hydraulic pivot means and said hydraulic cylinder rod being movably and rotatably supported by said second hydraulic pivot means;

w. whereby a downward motion of said hydraulic cylinder rod out of said hydraulic cylinder exerts a downward force to said movable cantilever arm which is transmitted to said movable jaw receiving member thereby causing said movable jaw receiving member to rotate about said movable jaw receiving means so that the movable jaw is forced to close against the fixed jaw with the result that any adjacent pieces of metal which may have been placed between the jaws when open will then be button punched, pressed or crimped together, and further wherein the force applied to said movable cantilever arm is substantially enhanced at the site of the fixed and movable jaws by a double leverage action arising from the distance between said second pivot means and said second hydraulic pivot means and further by the height of the upper shaft portion of the movable jaw receiving member over the height of the lower base portion of the movable jaw receiving member, and wherein an upward force on said movable cantilever arm created by an upward motion of said hydraulic cylinder rod into said hydraulic cylinder causes said fixed and movable jaws to open.

6. The invention as defined in claim 5 wherein said movable jaw contains a removable button receiving means which accommodates a removable button placed therein and said fixed jaw contains accommodating means to receive the protruding end of the removable button when the button puncher or crimper is in its closed position.

7. The invention as defined in claim 5 wherein said fixed jaw contains a removable button receiving means which accommodates a removable button placed therein and said movable jaw contains accommodating means to receive the protruding end of the removable button when the button puncher or crimper is in its closed position.

8. The invention as defined in claim 5 wherein the components of the improved button puncher or crimper are made of hardened metal such as Chrome-Molley Steel.

* * * * *